US008060951B2

(12) United States Patent
Smith

(10) Patent No.: US 8,060,951 B2
(45) Date of Patent: Nov. 22, 2011

(54) LOW PROFILE PROTECTIVE HELMET

(76) Inventor: Hosea Smith, Corydon, KY (US)

( * ) Notice: Subject to any disclaimer, the term of this patent is extended or adjusted under 35 U.S.C. 154(b) by 499 days.

(21) Appl. No.: 12/317,792

(22) Filed: Dec. 29, 2008

(65) Prior Publication Data

US 2009/0205113 A1 Aug. 20, 2009

Related U.S. Application Data

(60) Provisional application No. 61/009,368, filed on Dec. 28, 2007.

(51) Int. Cl.
*A42B 3/06* (2006.01)

(52) U.S. Cl. ..... 2/411; 2/414; 2/416; 2/423

(58) Field of Classification Search ..... 2/411, 414, 2/416, 423, 425, 909
See application file for complete search history.

(56) References Cited

U.S. PATENT DOCUMENTS 4,101,983 A * 7/1978 Dera et al. ..... 2/412
5,450,631 A * 9/1995 Egger ..... 2/425
5,794,272 A * 8/1998 Workman et al. ..... 2/421
5,950,243 A * 9/1999 Winters et al. ..... 2/411
6,081,931 A * 7/2000 Burns et al. ..... 2/411
6,272,692 B1 * 8/2001 Abraham ..... 2/411
6,609,254 B2 * 8/2003 Bielefeld et al. ..... 2/416
7,213,271 B1 * 5/2007 Bielefeld ..... 2/416
2002/0116749 A1 * 8/2002 Bielefeld et al. ..... 2/416
2005/0235403 A1 * 10/2005 Ide et al. ..... 2/425
2006/0048285 A1 * 3/2006 Bielefeld et al. ..... 2/416
2006/0206994 A1 * 9/2006 Rogers et al. ..... 2/418

* cited by examiner

*Primary Examiner* — Brian D Nash
(74) *Attorney, Agent, or Firm* — Gary K. Price

(57) ABSTRACT

A low profile protective helmet having an interior surface that is immediately adjacent the top of the wearer's head when the helmet is being worn. The interior surface defines a distal point which represents the furthest distance between the top of the wearer's head and the interior surface when the helmet is being worn. The height of the low profile helmet is approximately 4.7 inches and the distal point is approximately 1.3 inches to the top of the wearer's head which is at least 1 inch closer to the top of the wearer's head than with prior art hard hats. The close fit minimizes the weight of the helmet itself, and provides stability of the helmet on the head. The helmet includes shock absorbing means integral to the outer shell that defines a first extension and a second extension in perpendicular relationship with the first extension such that the outer shell is of a relatively greater depth along the defined extensions.

10 Claims, 2 Drawing Sheets

LOW PROFILE PROTECTIVE HELMET

CROSS REFERENCES TO RELATED APPLICATIONS

U.S. Provisional Application for Patent No. 61/009,368, filed Dec. 28, 2007, with title "Low Profile Protective Helmet" which is hereby incorporated by reference. Applicant claim priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable

BACKGROUND OF THE INVENTION

1. Field of the Invention

This invention relates generally to protective helmets and more particularly, to a low profile helmet that incorporates safety design for miners.

2. Brief Description of Prior Art

The use of safety helmets (hard hats) in hazardous areas in industry and mines is widespread. Prior art helmets are generally heavy and because the shell of the helmet is spaces an appreciable distance from the wearer's head, they are often unstable on the head. In addition, the bulk of these helmets seriously limit head movement by the wearer in the often confined space within the mine.

As will be seen from the subsequent description, the preferred embodiments of the present invention overcome disadvantages of the prior art.

SUMMARY OF THE INVENTION

The present invention is a low profile helmet suitable for use in hazardous areas in industry and mines. The invention comprises a helmet embodying a rigid shell that is best described as being made up of integral portions joined together to permit the helmet to be fitted closely to the top of the wearer's head. The close fit of the helmet minimizes the weight of the helmet itself, and provides excellent stability of the helmet on the head. Because of its close fit, low profile fitting with the wearer's head, the helmet of the present invention further includes integral shock absorbing means in order to protect the head of the wearer.

DESCRIPTION OF THE PREFERRED EMBODIMENT

The low profile protective helmet of the present invention is primarily directed to a close fit helmet that minimizes the weight of the helmet itself, and provides excellent stability of the helmet on the head. In the broadest context, the low profile protective helmet of the present invention consists of components configured and correlated with respect to each other so as to attain the desired objective.

The basic idea of the present invention is to provide a low profile helmet suitable for use in hazardous areas in industry and mines and that embodies a low profile, close fit in order to both minimize the weight of the helmet itself, and to provide excellent stability of the helmet on the wearer's head.

Figure 1:
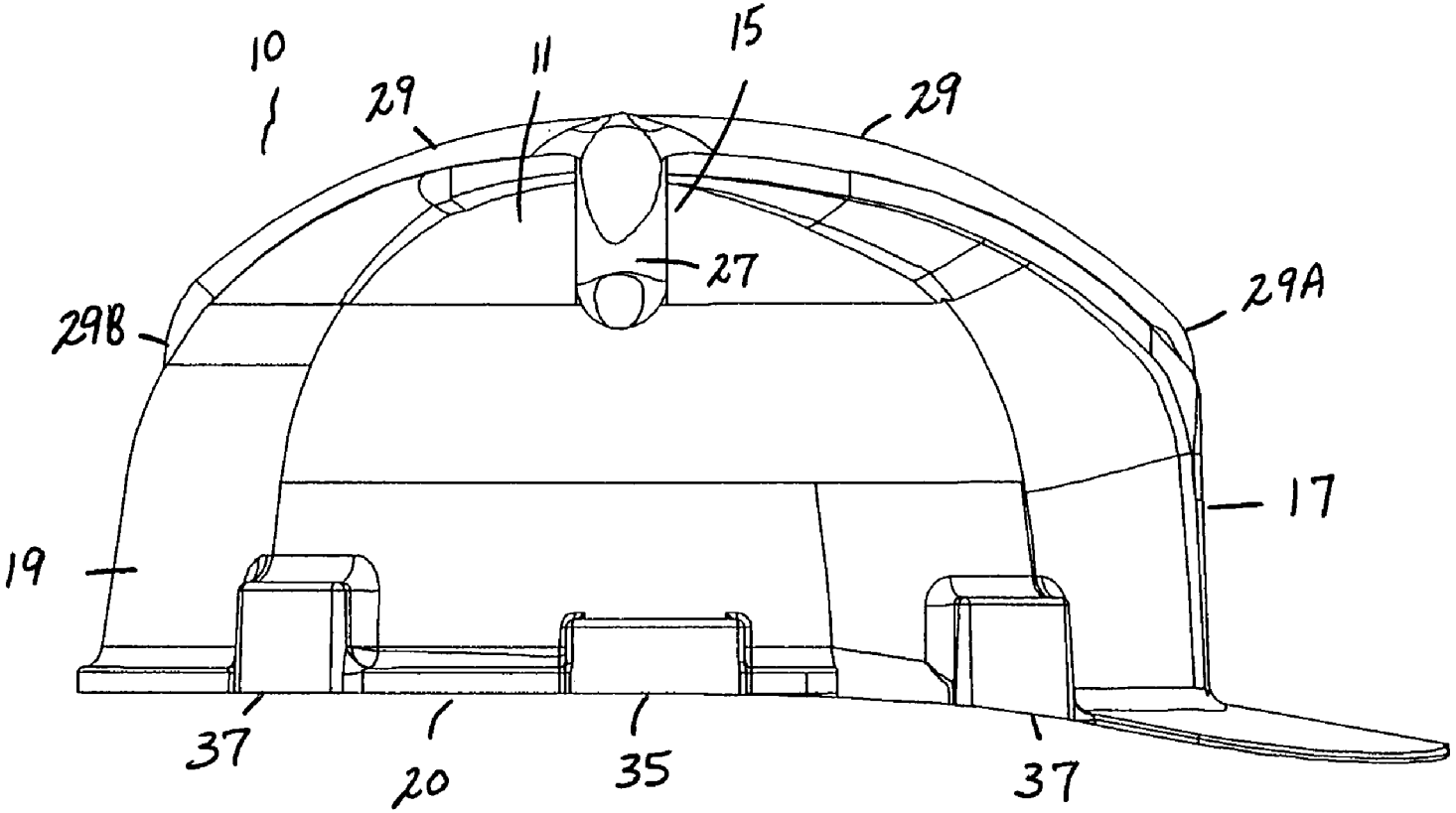
FIG. 1 is a side view of a preferred embodiment of the present invention, a low profile protective helmet.
Figure 2:
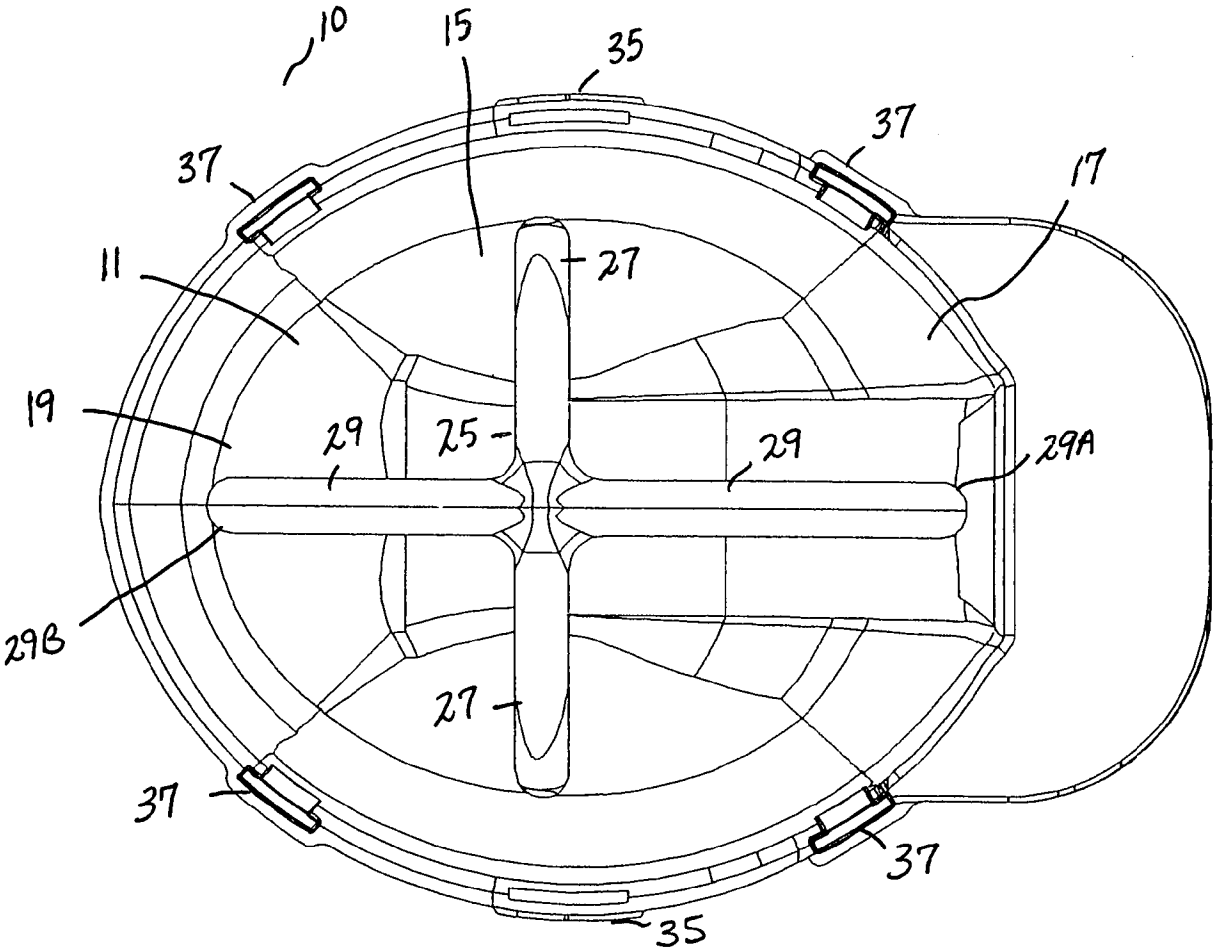
FIG. 2 is a top view of the protective helmet of FIG. 1.

Referring to FIGS. 1-2, a low profile protective helmet 10 made in accordance with the present invention is disclosed. The protective helmet 10 includes an outer shell 11 of a substantially rigid impact resistant material.

As is the case with prior art protective helmets, the current invention may include various attachments such as a mounted lamp, protective visor, ear pads, as well as shock absorbing internal padding disposed within the helmet 10 for both protection and comfort. Again these attachments are known in the art and therefore not apart of the present inventive disclosure.

As illustrated, the outer shell 11 having generally spherical contours to encompass the upper part of the wearer's head. The shell 11 is preferably made of a dense, relatively light weight, impact absorbing material such as for example, a polycarbonate plastic.

The outer shell 11 is integrally formed by three sections, a center principal section 15, a front section 17 and a rear section 19. The center section 15 covers the central portion of the top of the wearer's head from a point above the ear on one side of the head to a point above the ear on the other side of the head. The front section 17 is integral to the center section 15 and covers the upper frontal portion of the head. The rear section 19 is likewise integral to the center section 15 and covers the back of the head. The sides of all three sections are configured to closely fit the head of the wearer in order to better maintain firm contact with the area of the head while the helmet is being worn.

The outer shell 11 includes an interior surface 20 that is immediately adjacent the top of the wearer's head while the helmet is being worn. The helmet 10 defines a distal point 16 at its apex that is the furthest distance from the top of the wearer's head when the helmet 10 is being worn. The distal point 16 of the low profile helmet 10 is approximately 1.3" from the top of the wearer's head (ends 27A and 27B as will be further described) which is at least one (1) inch closer to the top of the wearer's head than with prior art hard hats. In particular, the height of the low profile helmet 10 is approximately 4.7" in height which is considerably less than prior art hard hats. As a result, the design permits the helmet 10 to fit closer to the top of the wearer's head. The close fit of the helmet 10 minimizes the weight of the helmet itself, and provides excellent stability of the helmet on the head.

As best shown in FIG. 2, the outer shell 11 further includes added shock absorbing means 25 that is preferably integral to the outer shell 11. The added shock absorbing means 25 includes a first extension 27 and a second extension 29 in perpendicular relationship with the first extension 27. Like the outer shell 11, the added shock absorbing means 25 is constructed of a substantially rigid impact resistant material and disposed on the outer shell 11 in order to give added protection to the head of the wearer such that the low profile helmet 10 is suitable for use in hazardous areas in industry and mines. In the preferred embodiment the added shock absorbing means 25 is the same material used to manufacture the outer shell 11 with relatively greater depth along the defined extensions 27, 29.

As illustrated, the extension 27 horizontally extends along the central portion of the center section 15 and extends such that ends 27A and 27B are approximately adjacent the top of the wearer's head while the helmet 10 is being worn.

The second extension 29 is disposed in perpendicular relationship to the first extension 27. The second extension 29 vertically extends along the central portion of the center section 15 and extends such that a first end 29A is approximately adjacent the front section 17 and a second end 29B is approximately adjacent the rear section 19. As stated, the extensions 27, 29 forming the added shock absorbing means 25 give added protection to the head of the wearer during use.

The inventor has found that the design of the protective helmet 10 as described represents the only ANSI Z89.1 Type I Class G certified hard hat having the "low profile" characteristics described.

While the best mode for carrying out the invention has been described, those familiar with the art to which this invention relates will recognize various alternative designs and embodiments for practicing the invention. Thus, the above-described preferred embodiment is intended to be illustrative of the invention which may be modified within the scope of the appended claims.

I claim:

1. A low profile protective helmet comprising:

an outer shell of a substantially rigid impact resistant material, said outer shell having generally spherical contours to encompass the upper part of a wearer's head, wherein said outer shell is integrally formed by a center section, a front section and a rear section, wherein said outer shell further includes an interior surface that is immediately adjacent the top of the wearer's head when the helmet is being worn, said helmet further includes a distal point at its apex, a pair of side slots, each of said side slots for attaching a hearing protection pad, side channels for attaching an internal suspension padding and, a rigid shock absorbing means integral to the outer shell including a first extension and a second extension in perpendicular relationship with said first extension, wherein said first extension horizontally extends along a central portion of the center section and defines first and second horizontal ends, and the second extension vertically extends along the central portion of the center section and extends such that a first end of said second extension is approximately adjacent the front section and a second end of said second extension is approximately adjacent the rear section, wherein said distal point is approximately 1.3 inches from said first and second horizontal ends.

2. A low profile protective helmet comprising:

an outer shell having generally spherical contours to encompass the upper part of a wearer's head, wherein said outer shell further includes an interior surface that is immediately adjacent the top of the wearer's head when the helmet is being worn, said protective helmet further defining a distal point at its apex, a pair of side slots, each of said side slots for attaching a hearing protection pad, side channels for attaching an internal suspension padding and, a rigid shock absorbing means integral to the outer shell, said shock absorbing means including a first extension and a second extension in perpendicular relationship with said first extension, said first extension having first and second ends that horizontally extend along a central portion of said outer shell, and wherein said distal point is approximately 1.3 inches from said first and second ends.

3. The low profile protective helmet as recited in claim 2, wherein said outer shell is constructed of a substantially rigid impact resistant material.

4. The low profile protective helmet as recited in claim 3, wherein the height of the low profile helmet is approximately 4.7 inches.

5. A low profile protective helmet comprising:

a front section, a center section and a rear section that forms an outer shell, said outer shell having generally spherical contours to encompass the upper part of a wearer's head, wherein said outer shell further includes an interior surface that is immediately adjacent the top of the wearer's head when the helmet is being worn, said outer shell further defines a distal point at its apex, side channels for attaching an internal suspension padding, a pair of side slots, each of said side slots for attaching a hearing protection pad, and, a rigid shock absorbing means integral to the outer shell, said shock absorbing means including a first extension and a second extension in perpendicular relationship with said first extension, and wherein said first extension horizontally extends along said center section and defines first and second ends, and wherein said distal point is approximately 1.3 inches from said first and second ends.

6. The low profile protective helmet as recited in claim 5, wherein said outer shell is constructed of a substantially rigid impact resistant material.

7. The low profile protective helmet as recited in claim 5, wherein said shock absorbing means is constructed of a substantially rigid impact resistant material.

8. The low profile protective helmet as recited in claim 5, wherein the height of the low profile helmet is approximately 4.7 inches.

9. The low profile protective helmet as recited in claim 8, wherein said outer shell is integrally formed by a center section, a front section and a rear section, and wherein said first extension horizontally extends along a central portion of the center section and the second extension vertically extends along the central portion of the center section and extends such that a first end of said second extension is approximately adjacent the front section and a second end of said second extension is approximately adjacent the rear section.

10. The low profile protective helmet as recited in claim 9, wherein said outer shell is of a relatively greater depth along said first and second extensions.

* * * * *